United States Patent [19]

McKay et al.

[11] Patent Number: 4,925,188

[45] Date of Patent: May 15, 1990

[54] TOY RACE TRACK AND LAP COUNTER

[76] Inventors: Robert S. McKay, 7420 Beckwith Rd., Morton Grove, Ill. 60053; William D. Nelson, 400 Bowen Ct., Elgin, Ill. 60120

[21] Appl. No.: 415,976

[22] Filed: Sep. 29, 1989

[51] Int. Cl.[5] ..... A63K 1/00; A63H 18/00; G06M 1/00; G07C 11/00

[52] U.S. Cl. ..... 273/86 R; 273/86 D; 446/176; 446/197; 446/444; 235/98 B; 235/99 R; 235/93

[58] Field of Search ..... 273/86 R, 86 D; 235/1 B, 1 C, 93, 116, 119, 98 A, 98 B; 446/197, 185, 180, 176, 178, 444

[56] References Cited

U.S. PATENT DOCUMENTS

| | | | |
|---|---|---|---|
| 3,228,600 | 1/1966 | May | 235/99 R |
| 3,618,397 | 11/1971 | Bosley et al. | 273/86 R |
| 3,628,725 | 12/1971 | Edwards et al. | 235/99 R |
| 3,667,672 | 6/1972 | Kennedy et al. | 235/98 B |
| 3,697,071 | 10/1972 | Anderson | 273/86 D |
| 4,070,024 | 1/1978 | Hamano | 273/86 D |
| 4,229,005 | 10/1980 | Barlow et al. | 273/86 D |

FOREIGN PATENT DOCUMENTS

| | | | |
|---|---|---|---|
| 2060415 | 5/1981 | United Kingdom | 273/86 R |

*Primary Examiner*—Edward M. Coven
*Assistant Examiner*—William M. Pierce
*Attorney, Agent, or Firm*—Charles J. Prescott

[57] ABSTRACT

A toy race track and lap counter comprising a track with adjacent lanes each forming a complete circuit and racing objects which are propelled around the track by pressurized air controllably discharging from separate nozzles in a propulsion tower. Separate air impulse devices are provided for each player for controlling the timing and intensity of each burst of pressurized air against that player's racing object as it passes by the propulsion tower and beneath the nozzles. A plurality of propulsion towers may also be provided which are operably interconnectable whereby simultaneous air bursts are applied at more than one location around the track by each player by manually timing the activation of that player's air impulse device.

12 Claims, 4 Drawing Sheets

10
12
14
14'
16
18
20
22
24
26
28
30
32
34
36
38

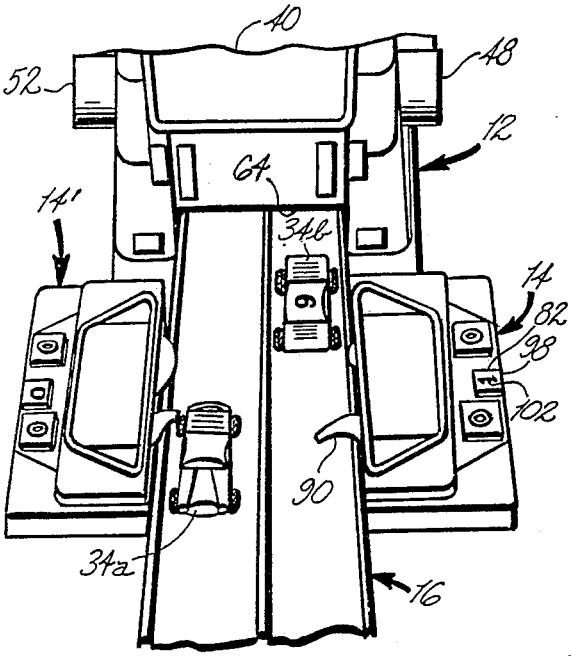
Fig. 11
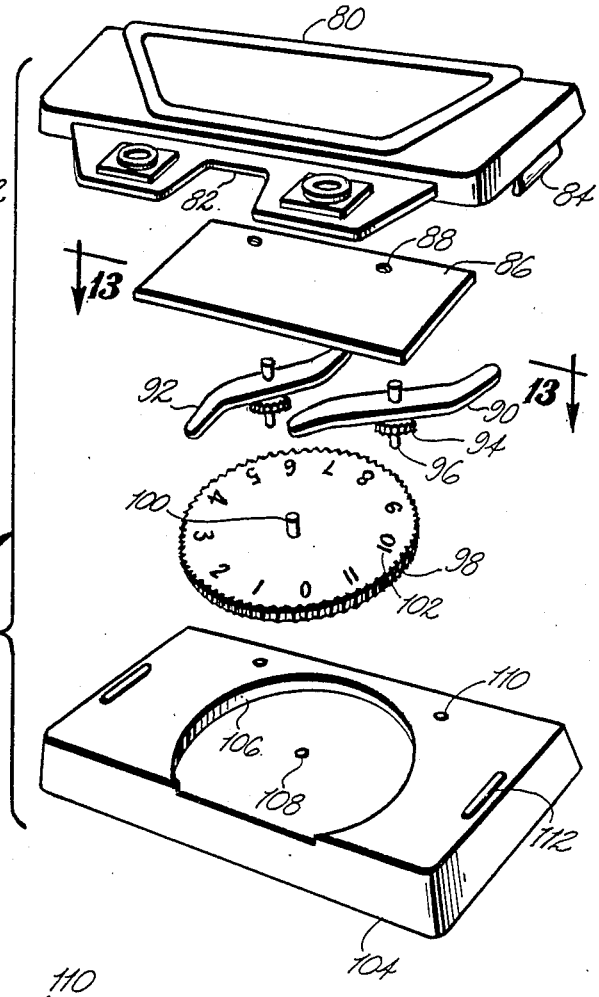
Fig. 12
Fig. 13
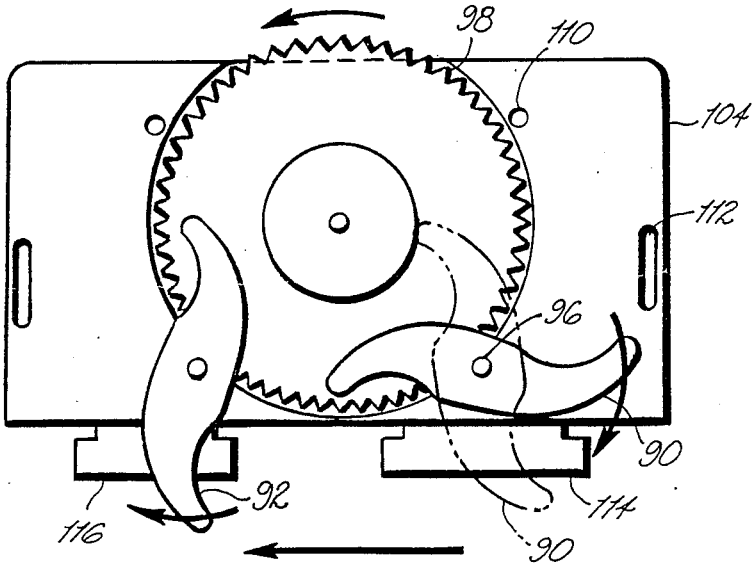

TOY RACE TRACK AND LAP COUNTER

BACKGROUND OF THE INVENTION

This invention relates generally to game devices, and more particularly to a novel toy race track and lap counter.

Many different propulsion devices are available for use in conjunction with toy race tracks. Although many such toy race tracks include self propelled racing objects, a vast number of these devices include racing objects which have independent propulsion means from that of the racing objects.

One such arrangement is disclosed in U.S. Pat. No. 4,229,005 to Barlow which is directed to a toy track racing game having a uniquely configured starting structure which confines and directs bursts of air from air apertures within the track and against the rear side of the facing objects at the start of the race. A pivoted door then momentarily swings open upon impact by the racing object as it passes thereby.

The present invention provides a unique propulsion tower and lap counter arrangement whereby bursts of air are individually applied by each player in terms of timing and intensity by use of separate air impulse means. No moving parts are required to propel the racing objects except for the manipulation of the air impulse means and the movement of the propelled racing objects along the track. Thus, the present invention is highly efficient in applying each burst of pressurized air to propel the racing objects. A plurality of stationary propulsion towers may be provided so that motivating air impulses may be applied against the racing objects at more than one location around the track to further increase the speed of the racing objects and to more evenly maintain speed.

BRIEF SUMMARY OF THE INVENTION

This invention is directed to a toy race track and lap counter comprising a track with adjacent lanes each forming a complete circuit and racing objects which are propelled around the track by pressurized air controllably discharging from separate nozzles in a propulsion tower. Separate air impulse devices are provided for each player for controlling the timing and intensity of each burst of pressurized air against that player's racing object as it passes by the propulsion tower and beneath the nozzles. A plurality of propulsion towers may also be provided which are operably interconnectable whereby simultaneous air bursts are applied at more than one location around the track by each player by manually timing the activation of that player's air impulse device.

It is therefore an object of this invention to provide a unique air propulsion system arrangement for propelling moveable racing objects around a continuous track.

It is another object of this invention to provide a toy racing track having unique air propulsion means and also including a unique lap counter which provides viewable indicia of the race in progress.

It is yet another object of this invention to provide a toy race track having no moveable components so as to increase game effectiveness and to reduce breakage and maintenance.

It is yet another object of this invention to provide a toy race track having unique air propulsion means adapted to a variety of racing objects.

In accordance with these and other objects which will become apparent hereinafter, the instant invention will now be described with reference to the accompanying drawings.

BRIEF DESCRIPTION OF THE DRAWINGS

FIG. 11 is a perspective view of the lap counter connected adjacent each lane of the track and adjacent the propulsion tower and depicting a racing object in position on the track.

FIG. 12 is an exploded perspective view of the lap counter.

FIG. 13 is a top plan view of a portion of the lap counter in the direction of arrows 13—13 in FIG. 12.

DETAILED DESCRIPTION OF THE INVENTION

Figure 1:
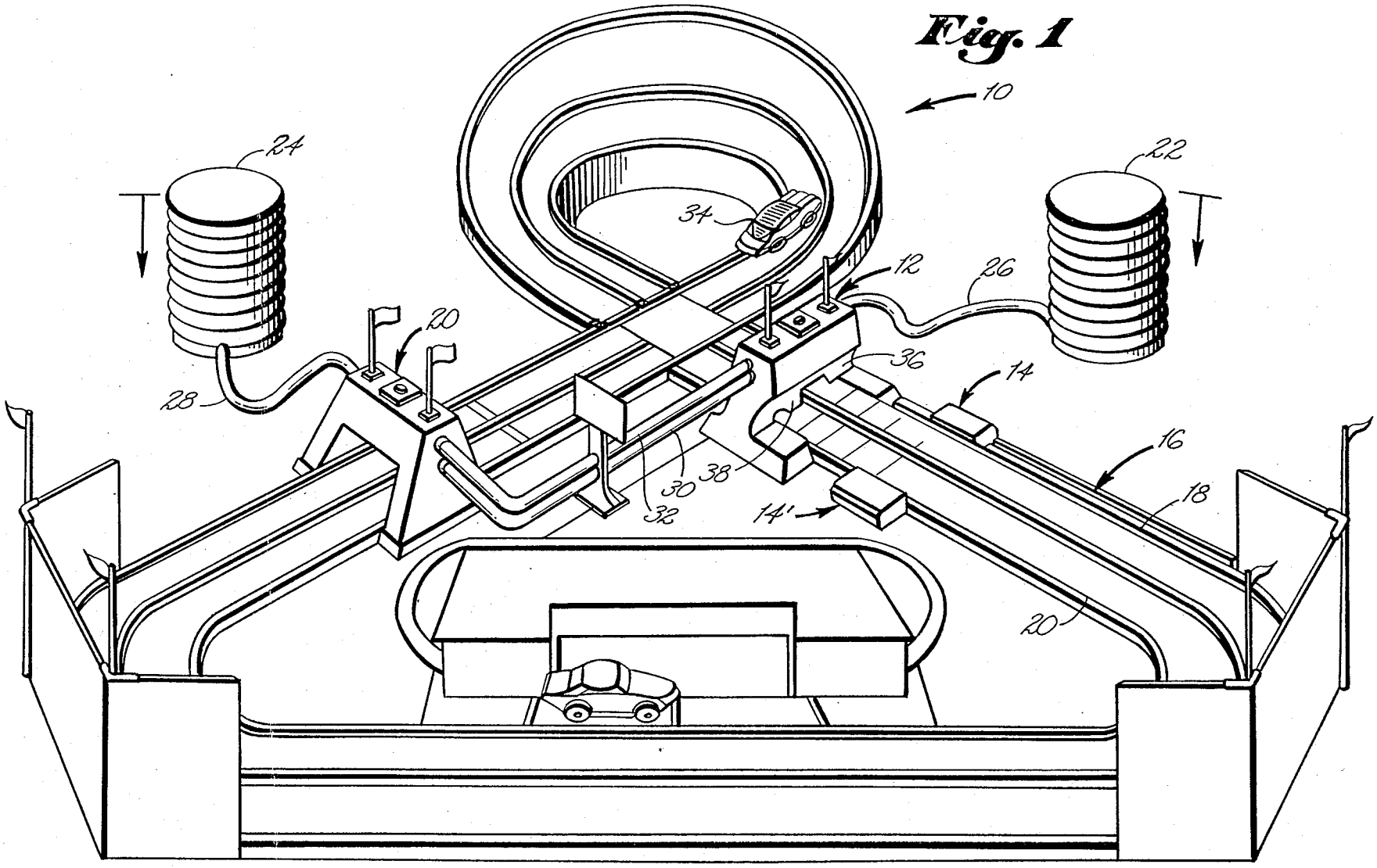
FIG. 1 is a pictorial view of the entire invention.
Figure 2:
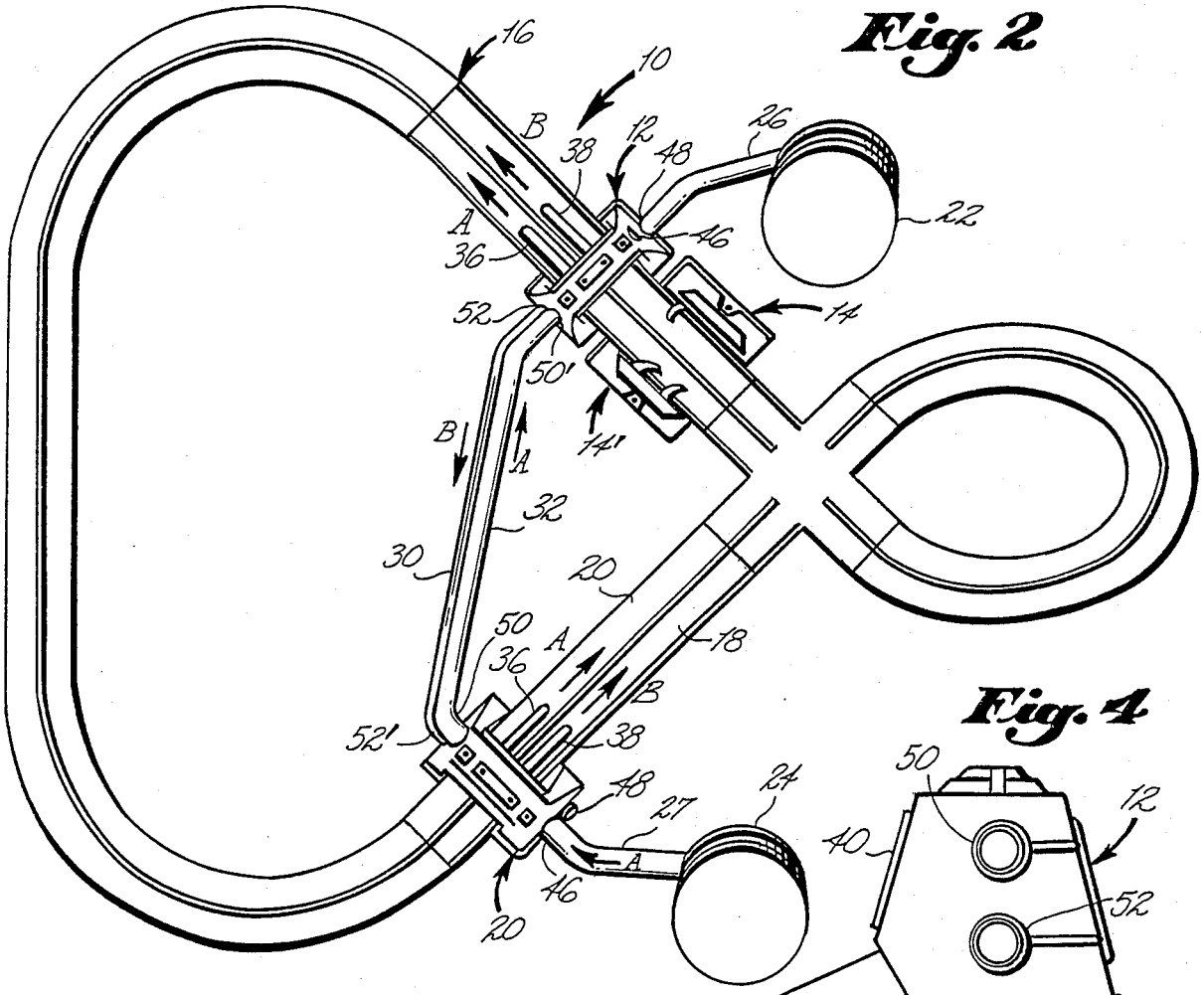
FIG. 2 is a top plan view of FIG. 1.

Referring now to the drawings, and particularly to FIGS. 1 and 2, the preferred embodiment of the invention is shown generally a numeral 10. The invention 10 includes a track shown generally at numeral 16 having at least two lanes 18 and 20 which are generally coextensive and form continuous circuits upon which a racing object such as that shown at numeral 34 may travel. The invention 10 also includes, in its preferred embodiment, two propulsion towers shown generally at numerals 12 and 20. It is here noted that these propulsion towers 12 and 20 are identical in structure and function except for their position along the track 16 and therefore, for convenience, two separate numerals are used for their designation.

Two air bellows 22 and 24, which are hand operated devices for creating a burst of pressurized air when downwardly depressed, are also provided. These bellows 22 and 24 are operably connected to propulsion towers 12 and 20 by conduits 26 and 27, respectively. The propulsion towers 12 and 20 are operably interconnected for air transfer by flexible conduits 30 and 32. The interaction between these elements and their usefulness in propelling the racing objects along the track 16 will be described herebelow.

Also provided in the preferred embodiment of the invention 10 are a pair of lap counters shown generally at numeral 14 and 14' which will be more fully described herebelow.

Both lap counters 14 and 14' and the propulsion towers 12 and 20 are connectable in stationary fashion with respect to the margins of track 16 in the positions shown.

Figure 4:
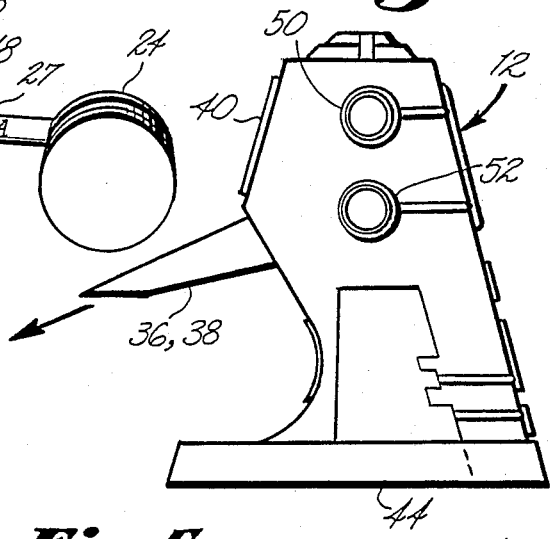
FIG. 4 is a side elevation view of FIG. 3 in the direction of arrows 4—4.
Figure 3:
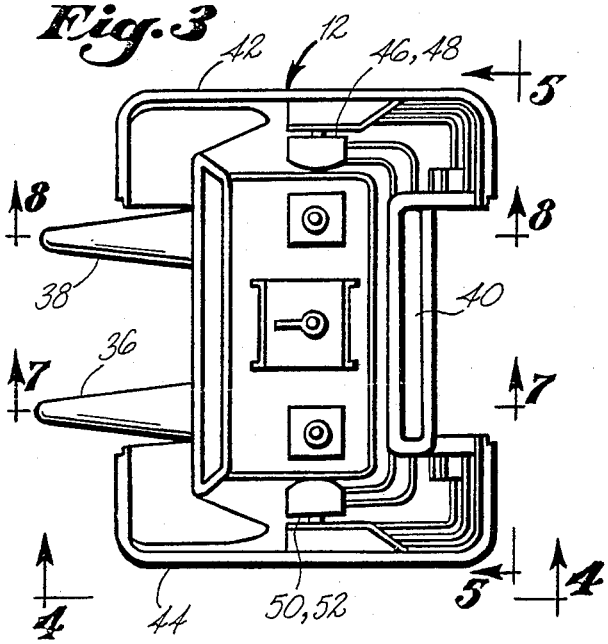
FIG. 3 is a top plan view of the propulsion tower of the invention.
Figure 5:
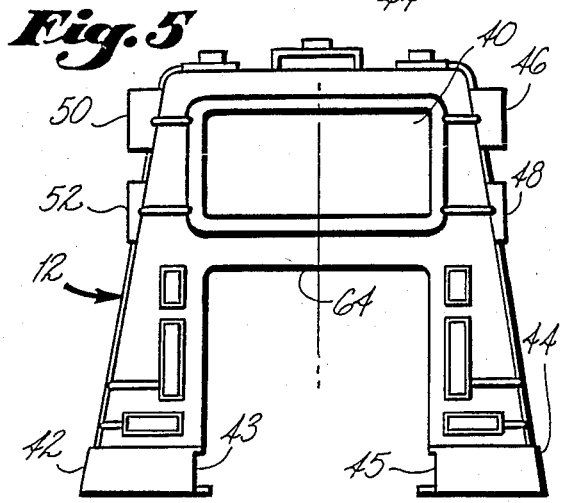
FIG. 5 is a rear elevation view of FIG. 3 in the direction of arrows 5—5.
Figure 6:
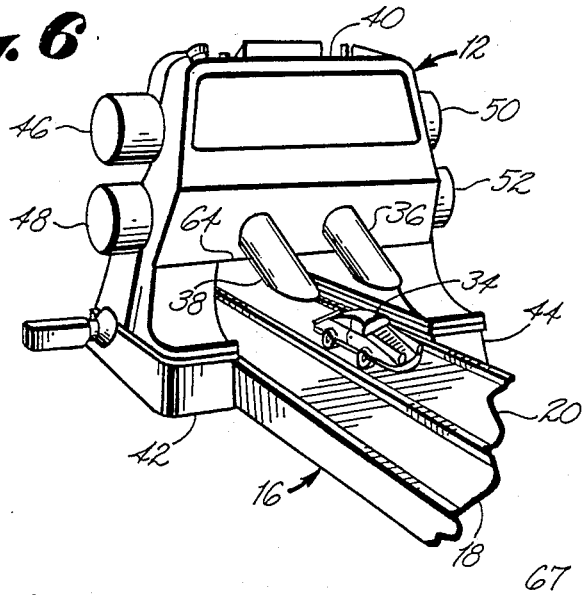
FIG. 6 is a perspective view of the propulsion tower connected around the segment of the race track and depicting a racing object in position on the track.
Figure 7:
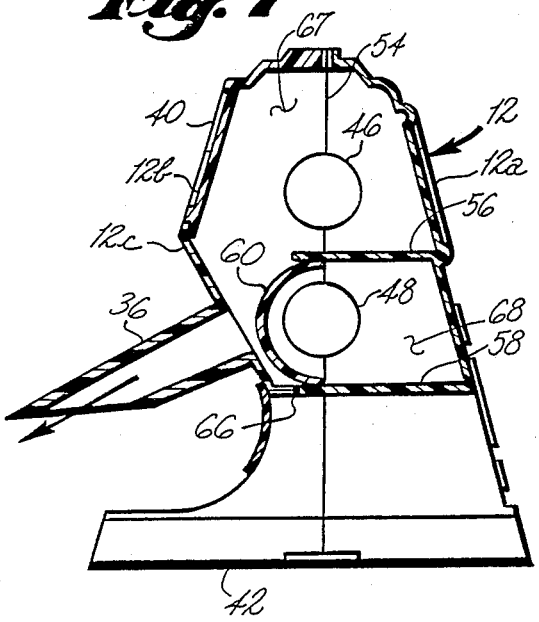
FIG. 7 is a section view in the direction of arrows 7—7 in FIG. 3.
Figure 8:
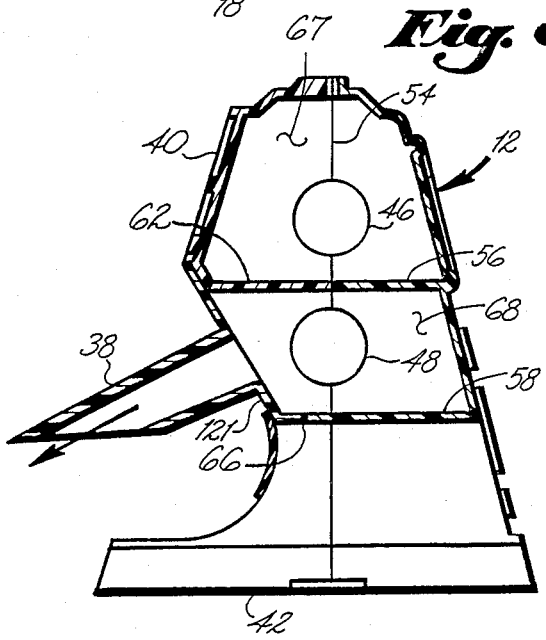
FIG. 8 is a section view in the direction of arrows 8—8 in FIG. 3.

Referring now additionally to FIGS. 3 to 8, the preferred embodiment of the propulsion tower is shown generally at numeral 12. Again, note that the propulsion tower shown generally at numeral 20 in FIGS. 1 and 2 is substantially identical to the propulsion tower designated as numeral 12 except with respect to its location and interconnection on track 16. In overall structure, each propulsion tower 12 (or 20) includes an air plenum chamber 40 and two downwardly extending legs 42 and 44. These legs 42 and 44 have recesses 43 and 45 which facilitate releasable interconnection to mating notches in the margins of track 16. The plenum chamber 40 is thus elevated by downwardly extending legs 42 and 44 so as to form arch 64 through which the racing objects may pass. Laterally extending from the plenum chamber are parallel nozzles 36 and 38 which are also elevated sufficiently above track 16 such that racing objects may freely pass thereunder. These nozzles 36 and 38 are aimed slightly downwardly as best shown in FIGS. 4, 7 and 8, to increase the overall efficiency of the propulsion towers 12 and 20.

The propulsion tower 12 and 20 is fabricated of thin molded plastic and is fabricated of three separate molded pieces shown at 12*a*, 12*b*, and 12*c* in FIGS. 7 and 8. Tower portions 12*a* and 12*b* are separated along parting line 54 while tower portion 12*a* and 12*c* are separated along parting line 66.

The propulsion tower 12 also includes inlet ports 46 and 48 and outlet ports 50 and 52. These ports 46, 48, 50, and 52 are interconnectable to flexible conduit 26, 30 and 32 whose function will be described herebelow.

Referring particularly to FIGS. 7 and 8, inlet 46 and outlet 50 are in fluid communication with plenum chamber 67 whereby pressurized air introduced into inlet 46 will discharge from both outlet 50 and nozzle 36 in the direction of the arrow adjacent nozzle 36. Separately, inlet 48 is in fluid communication with outlet 52 and nozzle 38 whereby pressurized air entering into inlet 48 is discharged from outlet 52 and nozzle 38 in the direction of the arrow adjacent nozzle 38.

Plenum chambers 67 and 68 are separated from fluid communication one to another by partitions 56 and 58 of tower portion 12*a* and which sealably mate with arcuate partition 60 of tower portion 12*b* with respect to nozzle 36 and with partition 62 with respect to nozzle 38.

Thus, when air bellows 22 is manually activated by downward depression of its top surface, a quantity of pressurized air is introduced into flexible conduit 26, transported to inlet 48 and into plenum chamber 68 of propulsion tower 12 for discharge out nozzle 38 as best seen in FIG. 8. A portion of the compressed air charge also discharges from outlet 52 and is transported by flexible conduit 30 to inlet 52′ of propulsion tower 20 for discharge from nozzle 38 of propulsion tower 20.

With respect to the inlet and outlet designation of propulsion towers 12 and 20, the same numerals have been maintained except redesignated to include a "′" with respect to inlet 50′ on propulsion tower 12 and 52′ on propulsion tower 20, both of which are utilized as inlets rather than outlets.

Continuing the functional system description, then, a portion of the air charge discharging from outlet 52 of propulsion tower 12 flows in the direction of arrow B into inlet 52′ of propulsion tower 20 and discharges from nozzle 38 in the direction of arrow B from propulsion tower 20.

Activation of air bellows 24 moves an air charge in the direction of arrow A through flexible conduit 27, into inlet 46 and discharges from nozzle 36, all in the direction of arrow A as shown. A portion of that pressurized air charge is also transmitted from outlet 50 into flexible conduit 32 in the direction of arrow A and enters into inlet 50′ of propulsion tower 12. That portion of the air charge then enters into plenum chamber 67 and discharges from nozzle 38 in the direction of arrow B with respect to propulsion tower 12.

Note that inlet 46 of propulsion tower 12 and inlet 48 of propulsion tower 20 are capped or plugged so that pressurized air entering into plenum chamber 67 of propulsion tower 12 and plenum chamber 68 of propulsion tower 20 exits only through nozzles 36 and 38 of propulsion towers 12 and 20, respectively.

In operation, as one player activates bellows 22, a charge of compressed air is discharged from nozzles 38 of both propulsion tower 12 and 20, while another player activating air bellows 24 causes a quantity of air to discharge from nozzles 36 on propulsion towers 12 and 20. Of course, the intensity with which the bellows are depressed determines the quantity and velocity of pressurized air discharging from these nozzles 36 and 38.

In use, then, a racing object 34 is placed in front of the air streams to be discharged from nozzles 36 and 38 of propulsion tower 12 which thus serves as the starting point of the race. Hand activation of each bellows 22 and 24 provide the initial blast of pressurized air from nozzles 36 and 38 to propel the racing objects along track 16. As the racing objects 34 pass beneath propulsion tower 20, the air bellows 22 and 24 are again activated to provide an additional burst of pressurized air to again accelerate the racing objects 34. Of course, the timing and intensity of activation of bellows 22 and 24 are key with respect to the velocity maintained by the racing objects 34 around the track 16.

Figure 9:
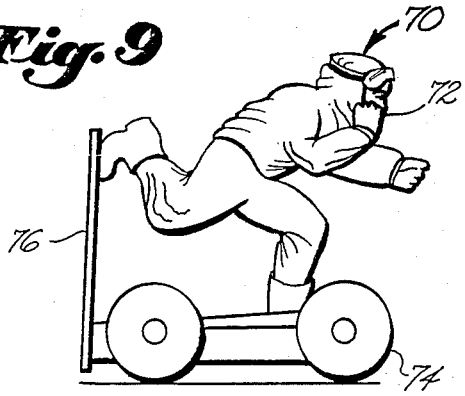
FIG. 9 is a side elevation view of another embodiment of a racing object.
Figure 10:
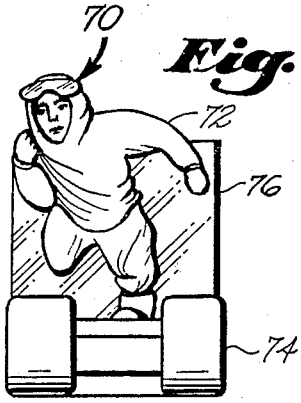
FIG. 10 is a front elevation view of FIG. 9.

Referring now to FIGS. 9 and 10, an alternate form of the racing objects are shown generally at numeral 70. These are in the form of human figurines and include wheels 74 which allow the racing object 70 to be easily propelled along the track 16. To enhance the effectiveness of the air blast discharging from nozzles 36 and 38, an upright plate 76 is also provided.

Referring lastly to FIGS. 11, 12 and 13, a pair of lap counters 14 and 14′ are provided connectable along opposing margins of track 16 by tabs 114 and 116 as shown in FIG. 13. Lap counter 14 is identical to 14′ except that the arms 90 and 92 as will be herebelow described, have been reversed to provide a right hand and left hand version. All further descriptions of the lap counter will be with respect to numeral 14, keeping in mind that the lap counter 14′ is a mirror image thereof with respect to arms 90 and 92. The right hand and left hand versions 14 and 14′ are selected at assembly.

Referring particularly to FIG. 12, the lap counter 14, formed of molded plastic components, includes a base 104 having a central aperture 108 and a concentric circular cavity 106, both of which are structured to receive dial 98. The mounting shaft 100 of dial 98 rotatably fits within aperture 108. Dial 98, having peripheral gear teeth, also includes consecutive lap indicia 102 which may be viewed to determine the number of times a racing object has passed the lap counter 14 as will be herebelow described.

The pair of arms 90 and 92 are identical. They are given different designations to assist in describing the sequence of their operation and thus only arm 90 will be physically described with numeral designation. Arm 90 includes central mounting shaft 96 having a concentric gear 94 as shown. These arms 90 and 92 are rotatably mounted in apertures 110 such that gears 94 interact with the peripheral toothed gear formed into the dial 98 whereby, as best seen in FIG. 13, when arms 90 and 92 are rotated in the direction of their arrows, dial 98 rotates in unison in proportion to the number of gear teeth selected on each.

So as to allow arms 90 and 92 to freely rotate as a racing object passes thereby on track 16, but to prevent free continued motion of the arms 90 and 92 thereafter, friction plate 86 is also provided. Apertures 88 in friction plate 86 mateably align atop mounting shafts 96 and friction plate 86 thus contacts the upper surface of arms 90 and 92. The friction created by this contact which is produced by nothing more than the overall weight of friction plate 86 thus prevents arms 90 and 92 from freely spinning except in response to the passage thereby of a racing object.

Cover 80 is also provided and includes connector tabs 84 which retainably fit within mating slots 112 in base 104. Cover 80 includes notch 82 which aligns with one numeral of indicia 102 to allow viewable indication of the number of times that a racing object has passed by the lap counter 14.

It should be thus understood, particularly with reference to FIGS. 11 and 13, that, because arms 90 and 92 are arranged perpendicular one to another at assembly, as a racing object shown at 34*a* in FIG. 11 begins to pass by the lap counter 14, the first-encountered arm 90 rotates from the position shown in phantom in FIG. 13 in the direction of the arrow into the position shown in solid lines in FIG. 13. Continuation of movement of the racing object so as to contact arm 92 continues the rotation of all three elements, arm 90, arm 92 and dial 98 in the direction of the arrows, respectively so that, when the racing object 34 or 70 fully passed, arm 90 will be rotated back to its position shown in FIG. 13. Thus, by each passing of each lap counter 14 and 14', arms 90 and 92 rotate 180° and dial 98 moves so that the next indicia 102 in sequence appears in notch 82.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A toy race track comprising:

a track having at least two side-by-side lanes, each said lane making a complete circuit;

racing objects propellable along and atop said track;

a first propulsion tower connectable to said track;

said first propulsion tower having a plenum chamber end downwardly extending leg support means for positioning and supporting said plenum chamber centrally above and generally transversely spanning the width of said track whereby said racing objects can freely pass beneath said plenum chamber;

said plenum chamber having a first and second air inlet and a first and second air discharge nozzle;

said plenum chamber also having internal partitioning forming separate air passageways between said first inlet and said first nozzle and between said second inlet and said second nozzle, respectively;

said first and second nozzles parallel and spaced apart, each said nozzle configured to discharge air generally away from said first propulsion tower in the same direction one to another and generally horizontally above one said lane;

first and second air impulse means operably connectable to said first and second inlets, respectively for repeatedly providing a variable quantity of pressurized air for discharge from each of said first and second nozzles, respectively to propel said racing objects over said track.

2. A toy race track as set forth in claim 1, wherein:

said first propulsion tower includes first and second outlets in fluid communication with said first and second inlets of said first propulsion tower, said first and second outlets of said first propulsion tower operably connectable to first and second inlets of a second said propulsion tower, respectively;

said second propulsion tower substantially the same as said first propulsion tower and connectable to said track at a different position along said track from said first propulsion tower whereby a variable quantity of pressurized air discharges from each of said first and second nozzles of said first and second propulsion towers, respectively in response to each independent activation of said first and second air impulse means, respectively.

3. A toy race track as set forth in claim 1, wherein:

said first and second nozzles are elongated and slightly downwardly pointing for enhanced propulsion of said racing objects.

4. A toy race track as set forth in claim 1, wherein:

said first and second air impulse means are independently hand-operated air bellows.

5. A toy race track as set forth in claim 1, wherein:

said leg support means is an elongated leg positioned at each end of said plenum chamber and downwardly extending to said track to form an arch with said plenum chamber whereby said racing objects can freely pass through said arch.

6. A toy race track as set forth in claim 1, further comprising:

a lap counter connectable to said track for recording the number of circuits each said racing object completes.

7. A toy race track as set forth in claim 1, wherein said lap counter comprises:

a base having a mounting surface including means for receiving a rotatable dial;

said dial having evenly spaced viewable sequenced indicia of completed track circuits by the racing object formed into the upper surface of said dial and also having gear teeth formed into the circular edge of said dial;

said base having a first edge positioned along and generally parallel to the track;

two generally identical, elongated, slender arms each pivotally mounted in said base about a central axis of each said arm in spaced apart relation adjacent said first edge;

said arms having gear teeth which interact with said dial gear teeth whereby said dial rotates positively in response to rotation of said arms;

said arms lying in a plane and fixedly oriented generally perpendicular one to another by positive interengagement between said gear teeth on said arms and said dial;

at least one said arm always extending at least partially over said track whereby the racing object causes said arms and said dial to rotate in unison a predetermined amount each time the racing object passes by said lap counter on the track;

friction means positioned adjacent and acting upon said arms for insuring that said arms rotate only in direct response to the racing object passing by said lap counter and halting arm rotation immediately thereafter;

a cover connected atop said base and enclosing said friction means, said arms, and said dial, but permitting said arms to outwardly extend for rotation;

said cover having an opening for permitting viewing of one of said indicia at a time whereby the number of times the racing object has passed said lap counter may be viewably determined.

8. A toy race track as set forth in claim 7, wherein:

said friction means is a flat friction plate which rests horizontally atop said arms and exerting rotation-halting friction upon said arms in proportion to the weight of said friction plate.

9. A lap counter connectable to a toy race track for recording the number of times a racing object completes one circuit of the track, said lap counter comprising:

a base having a mounting surface including means for receiving a rotatable dial;

said dial having evenly spaced viewable sequenced indicia of completed track circuits by the racing object formed into the upper surface of said dial and also having gear teeth formed into the circular edge of said dial;

said base having a first edge positioned along and generally parallel to the track;

two generally identical, elongated, slender arms each pivotally mounted in said base about a central axis of each said arm in spaced apart relation adjacent said first edge;

said arms having gear teeth which interact with said dial gear teeth whereby said dial rotates positively in response to rotation of said arms;

said arms lying in a plane and fixedly oriented generally perpendicular one to another by positive interengagement between said gear teeth on said arms and said dial;

at least one said arm always extending at least partially over said track whereby the racing object causes said arms and said dial to rotate in unison a predetermined amount each time the racing object passes by said lap counter on the track;

friction means positioned adjacent and acting upon said arms for insuring that said arms rotate only in direct response to the racing object passing by said lap counter and halting arm rotation immediately thereafter;

a cover connected atop said base and enclosing said friction means, said arms, and said dial, but permitting said arms to outwardly extend for rotation;

said cover having an opening for permitting viewing of one of said indicia at a time whereby the number of times the racing object has passed said lap counter may be viewably determined.

10. A lap counter as set forth in claim 9, wherein:

said friction means is a flat friction plate which rests horizontally atop said arms and exerting rotation-halting friction upon said arms in proportion to the weight of said friction plate.

11. A toy race track comprising:

a track having at least two side-by-side lanes each making a complete circuit;

racing objects rollably propellable along and atop said track;

propulsion means connectable to said track for independently manually propelling said racing objects along said track;

a lap counter connectable to said track for recording the number of times said racing object completes one circuit of said track, said lap counter comprising a base, a dial, two arms, friction means and a cover;

said base having a mounting surface including means for receiving a rotatable dial;

said dial having evenly spaced viewable sequenced indicia of completed track circuits by the racing object formed into the upper surface of said dial and also having gear teeth formed into the circular edge of said dial;

said base having a first edge positioned along and generally parallel to the track;

said arms are generally identical, elongated, and slender, each pivotally mounted in said base about a central axis of each said arm in spaced apart relation adjacent said first edge;

said arms having gear teeth which interact with said dial gear teeth whereby said dial rotates positively in response to rotation of said arms;

said arms lying in a plane and fixedly oriented generally perpendicular one to another by positive interengagement between said gear teeth on said arms and said dial;

at least one said arm always extending at least partially over said track whereby the racing object causes said arms and said dial to rotate in unison a predetermined amount each time the racing object passes by said lap counter on the track;

said friction means positioned adjacent and acting upon said arms for insuring that said arms rotate only in direct response to the racing object passing by said lap counter and halting arm rotation immediately thereafter;

said cover connected atop said base and enclosing said friction means, said arms, and said dial, but permitting said arms to outwardly extend for rotation;

said cover having an opening for permitting viewing of one of said indicia at a time whereby the number of times the racing object has passed said lap counter may be viewably determined.

12. A toy race track as set forth in claim 11, wherein:

said friction means is a flat friction plate which rests horizontally atop said arms and exerting rotation-halting friction upon said arms in proportion to the weight of said friction plate.

* * * * *